United States Patent [19]

Petrone

[11] 4,422,633

[45] Dec. 27, 1983

[54] SIMULATED WHEEL IMMOBILIZING APPARATUS

[76] Inventor: John J. Petrone, 110 Roberts La., Apt. 100, Alexandria, Va. 22314

[21] Appl. No.: 290,441

[22] Filed: Aug. 6, 1981

Related U.S. Application Data

[63] Continuation-in-part of Ser. No. 129,552, Mar. 12, 1980, abandoned.

[51] Int. Cl.[3] ..... A63J 5/02

[52] U.S. Cl. ..... 272/8 N; 273/DIG. 2

[58] Field of Search ..... 40/1, 587, 538; 272/8 N; 70/225, 226, 14; 273/DIG. 2

[56] References Cited

U.S. PATENT DOCUMENTS

| | | | |
|---|---|---|---|
| 2,169,237 | 8/1939 | Gasco | 40/587 |
| 3,005 ,906 | 10/1961 | Butler | 40/587 |
| 3,132,859 | 5/1964 | Braunhut | 272/8 N |
| 3,828,590 | 8/1974 | Thiebault | 70/225 X |
| 3,973,772 | 8/1976 | Milliken | 272/8 N X |
| 4,221,380 | 9/1980 | Miller et al. | 40/538 |

FOREIGN PATENT DOCUMENTS

| | | | |
|---|---|---|---|
| 579655 | 10/1924 | France | 40/587 |

*Primary Examiner*—George J. Marlo
*Attorney, Agent, or Firm*—Henderson & Sturm

[57] ABSTRACT

This invention relates generally to novelty devices which do not function in accordance with the function normally associated with their external appearance, and more specifically to a simulated vehicle wheel immobilizing device, which is spaced from the wheel and will fracture or deform if the wheel is moved, and which is employed in combination with a printed folder in the form of a traffic ticket to not only elicit an amusing reaction from the driver of the vehicle, but also to promote the perpetrators goods or services in a commercial vein.

6 Claims, 3 Drawing Figures

SIMULATED WHEEL IMMOBILIZING APPARATUS

BACKGROUND OF THE INVENTION

This application is a continuation-in-part application of U.S. patent application Ser. No. 129,552, filed Mar. 12, 1980 now abandoned.

The prior art is repleted with novelty devices which are similar to external appearance and configuration to common everyday items whose purpose and function are well recognized, but when they are incorporated into a novelty device the structure is subtly altered so that they function in a manner totally unexpected and foreign to the normal experience of the user and/or casual observer. Examples of such devices can be found in most novelty shops and comprise such items as leaking water glasses, rubber tined forks, exploding golf balls, and water squirting flowers to name but a few.

One such commonplace item, which is very familiar to the residents of some major cities, is a device which is used by local law enforcement agencies to immobilize a motor vehicle, and which is known regionally as the "Denver" or "French" Boot among other appelations.

The Boot is designed to encompass a portion of one of the wheels and encircle the axle, so that it is virtually impossible to move the vehicle without incurring substantial damage thereto. The device is normally attached to a wheel on the drivers side, has sufficient size and is painted such a bright color, that the operator of the vehicle cannot fail to notice its presence upon returning to the vehicle. Upon the exterior surface of the boot, or imprinted on a sheet of paper which is placed under a windshield or imprinted on a sheet of paper which is placed under a windshield wiper, are a phone number or directions for the operator, which if called or followed will obtain the release of the car, usually after payment of a fine for outstanding traffic tickets.

When a vehicle operator first sees the boot he/she may experience one or more of the following emotions; anger, frustration, anxiety, chagrin, perplexion, guilt, confusion, and/or surprise.

By incorporating the external configuration of the boot into a novelty device the same reactions will be elicited, followed by relief, laughter and other responses associated with a successful, humorous, harmless prank or practical joke.

However, the present invention is not only intended as a novelty device, but also serves a commercial function in that it is intended for use in combination with a printed flyer, which has the external appearance of a traffic ticket or summons, but in reality is promotional advertising for the users goods or services.

SUMMARY OF THE INVENTION

An object of the present invention is the provision of a device which will serve a commercial as well as a novelty or amusement function, when it is disposed on and around a motor vehicle exterior.

Another object of the present invention is the provision of a device, which has one component which simulated a wheel immobilizing device, and is fabricated from a fragile or flexible, material which will not render the motor vehicle inoperative, nor will it mar or damage any vehicle surface, should the vehicle operator attempt to move the car.

Still another object of the instant invention is the provision of a combined novelty and advertising device which will initially cause consternation for the vehicle operator when first seen, which will then be followed by immense relief and amusement on the part of the operator, hopefully followed by the utilization of the perpetrators goods or services, when the operator realizes that the device is a unique promotional gimmick.

A still further object of the present invention is the provision of an amusement device, which will concentrate a poential consumers attention on the products or services offered by the user of this device.

A yet further object of the instant invention is the promotion of sales or services to a potential customer, by forcing them to read literature, which has the outward appearance of a traffic ticket or summons used in conjunction with a wheel immobilizing devia; but which in reality, is an novel advertising ploy, by virtue of the closing appearance of this device's components of the real thing.

DETAILED DESCRIPTION OF THE PREFERRED EMBODIMENT

Figure 1:
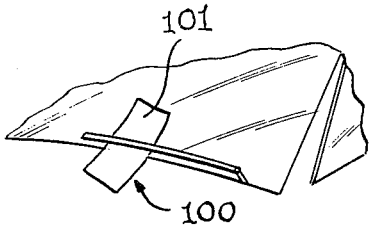
FIG. 1, is a perspective view of the combined novelty and advertising device of the instant invention as it would appear disposed on and around a motor vehicle.

The first major component of the combined novelty and advertising device of the instant invention is designated generally as 10 and comprises an enlarged portion 20 which is dimensioned to be spaced from or releasably secured to the hub 30 of a wheel 40 on a motor vehicle 50. The enlarged portion 20 is dimensioned such that it will overlap a portion of the hub 30.

At least one elongated arm 21 projects from the side of the enlarged portion 20 and extends beyond the radius of the wheel 40. At a point 22 beyond the radius of the wheel, arm 21 is bent inwardly a distance "A" which is greater than the axial width of the wheel 40. At a point 23 the arm 21 is again bent towards the axle 45 a short distance "B" so that the arm 21 is L-shaped in configuration and partially encloses at least one side of the wheel 40.

Depending upon the type of boot being used in a given geographical area, the enlarged portion 20 may be provided with an additional extension 25 which also projects beyond the radius of wheel 40.

The exterior configuration of the first major component 10 will vary from region to region due to the structural differences in the type of actual wheel immobilizing device employed, however, two structural features which will not vary are the simulated hub attaching portion 20, and at least one extension 21 projecting therefrom, beyond the periphery of the wheel 40.

Both the first 10 and second 100 major components may be fabricated from the same material i.e. plastic, styroform, paper, cardboard, etc. The criterial for the particular material employed, is that it must be light, fragile or flexible, inexpensive, easy to form into the desired configuration, and capable of having a color similar to the one used by the local law enforcement agencies, i.e. bright red, yellow or orange.

Figure 2:
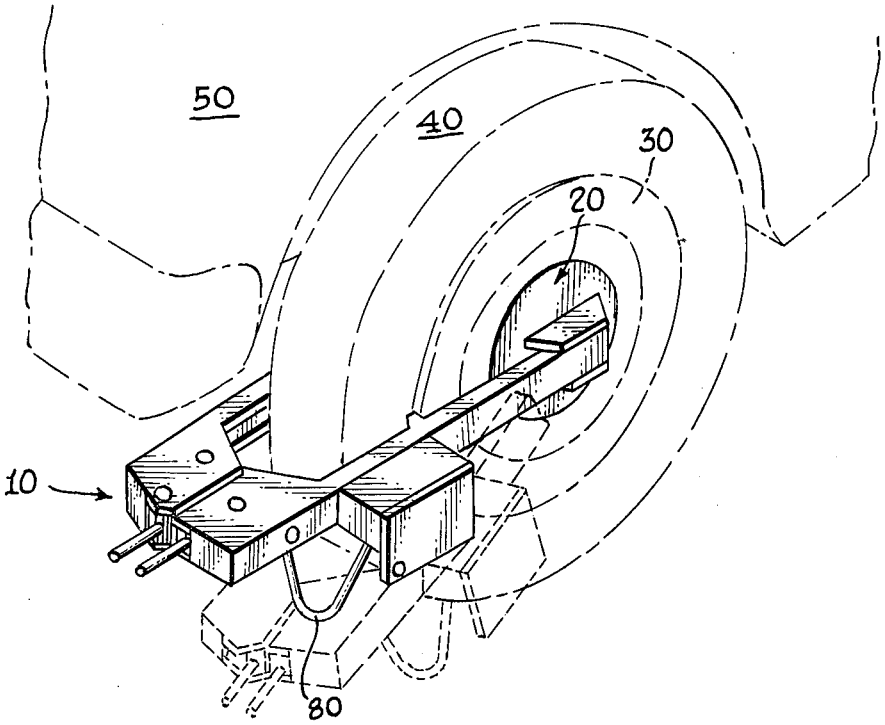
FIG. 2, is a side view of one major component of the combined novelty device.
Figure 3:
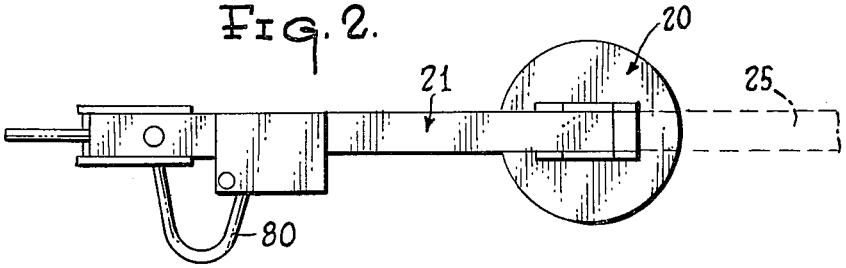
FIG. 3, is a top view of the one major component of FIG. 2, and the manner in which it is spaced from but surrounds a vehicle wheel.
Figure 3:
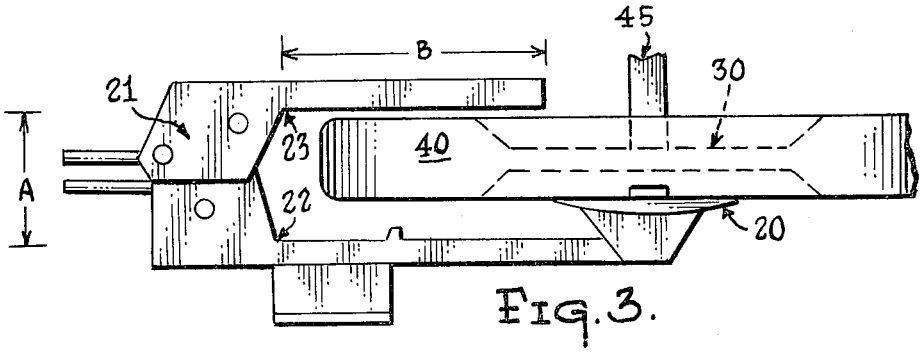

In the preferred embodiment illustrated in FIGS. 1–3, the enlarged portion 20 is provided with support legs 80, which will support the arm 21 generally parallel to the ground, and position the first major component 10 adjacent to, but not in actual contact with, the wheel itself. This structure is designed to avoid objections, which some drivers might have, to having any device physically attached to their vehicle without their consent.

In an alternative embodiment, the first major component 10 is provided with releasable securing means (not shown) such as adhesive patches, elastic bands, string, suction cups etc. which permit the device to be readily attached and removed from the wheel hub 30. When this embodiment is employed it would not be necessary to provide the enlarged portion 20 with the support legs 80, since the releasable securing means perform the function.

Referring once again to FIG. 1, it can be seen that the second major component 100 comprises a printed sheet of material 101 having the same general size and color as the traffic citations or tickets, which are issued in the area where the combined novelty and advertising device is intended for use. However, in keeping with the purpose and intent of this invention, the printed material will identify the user of the device, and bear advertising promoting a commercial establishments goods or services.

Anyone who is familiar with the operation of an actual wheel immobilizing device, knows that it is impossible to move the vehicle to which it is attached. They are also aware that the ticket or summons will indicate the procedure that they must go through to have the device removed. Bearing these two facts in mind; it should be readily apparent what an effective humorous advertising device the two major components form when they are used in combination with a vehicle.

First of all the major component 10 does not have to be an exact replica of the actual device, but only a crude representation thereof. Since most people are not intimately familiar with the exact configuration of the actual device; it is only necessary, to accomplish the intent and purpose of this invention, to give the impression that the first major component is a functional or operational device.

Once that erroneous impression has been made on the vehicle operator, by virtue of the external configuration of the first component, the mutural reaction is to ignore the first component, and inspect the second component for the pertinent information.

The utilization of this device around the exterior of a potential customers vehicle; therefore makes use of conditioned responses, to promote the perpetrators goods or services, and at the same time provide a unique, novel and humorous structure for advertising.

Having thereby disclosed the subject matter of the instand invention it should be obvious that many substitutions, modifications and variations are possible in light of the above teachings and the invention as disclosed should be limited only by the breadth and scope of the appended claims.

What I claim is:

1. A novelty/advertising device for use in combination with the windshield and one wheel of a vehicle, wherein the device comprises:

a first flexible major component dimensioned to be disposed around, but spaced from, at least a portion of the said one wheel, and further having an exterior configuration which closely resembles a wheel immobilizing device, wherein the first major component comprises an enlarged portion dimensioned to overlie a portion of the hub of the said one wheel, and an elongated L-shaped arm projecting from the enlarged portion and extending beyond the radius and at least a portion of the width of the vehicle wheel, and at least one downwardly depending support element disposed on the first major component, and dimensioned to support the said enlarged portion adjacent to, but spaced from, the hub whereby the first major component may be positioned adjacent to, but spaced from one wheel of a vehicle, to give the impression that a wheel immobilizing device has been physically attached to said one wheel, and a second flexible major component adapted to be placed on the windshield of a vehicle, wherein the second major component is dimensioned and colored so as to resemble a traffic ticket commonly issued in a given geographical area, and has promotional material imprinted thereon, in lieu of the language found on a traffic summons.

2. A novelty/advertising device as in claim 1; wherein the device is fabricated from plastic.

3. A novelty/advertising device as in claim 1; wherein the device is fabricated from folded cardboard.

4. A novelty/advertising device as in claim 1; wherein the device is fabricated from styrofoam.

5. A novelty/advertising device as in claim 1; wherein the enlarged portion has another elongated arm projecting therefrom.

6. A novelty/advertising device as in claim 5; wherein another elongated arm supports the enlarged portion adjacent to, but spaced from the hub of the wheel.

* * * * *